United States Patent [19]

Caruso

[11] 4,263,156

[45] Apr. 21, 1981

[54] GREASE COMPOSITIONS

[75] Inventor: Gerard P. Caruso, New Orleans, La.

[73] Assignee: Shell Oil Company, Houston, Tex.

[21] Appl. No.: 106,301

[22] Filed: Dec. 21, 1979

[51] Int. Cl.[3] ..... C10M 5/20; C10M 5/12; C10M 7/32; C10M 7/30

[52] U.S. Cl. ..... 252/51.5 A

[58] Field of Search ..... 252/51.5 A

[56] References Cited

U.S. PATENT DOCUMENTS

| | | | |
|---|---|---|---|
| 2,710,839 | 6/1955 | Sivakon et al. | 252/51.5 A |
| 3,242,210 | 3/1966 | Dreher et al. | 252/51.5 A |
| 3,243,372 | 3/1966 | Dreher et al. | 252/52.5 A |
| 3,401,027 | 9/1968 | Dreher et al. | 252/51.5 A |
| 3,846,314 | 11/1974 | Dreher et al. | 252/51.5 A |

*Primary Examiner*—Herbert Levine
*Assistant Examiner*—Irving Vaughn
*Attorney, Agent, or Firm*—Albert J. Adamcik

[57] ABSTRACT

Grease compositions containing a composite polyurea grease thickener are disclosed.

4 Claims, No Drawings

GREASE COMPOSITIONS

BACKGROUND OF THE INVENTION

The requirement that grease compositions provide adequate lubrication at high temperature for extended periods of time has become increasingly important. For this reason, many grease compositions contain a variety of organic thickening agents, such as those containing multiple uriedo or urea functional groups. A number of patents, e.g., U.S. Pat. Nos. 3,846,314; 3,242,210 and 3,243,372 disclose specialized thickening agents for various fluids, the thickening agents being obtained by reacting a three component reactant mixture comprising a monoamine, a polyamine and a diisocyanate, or a monoisocyanate, a diisocyanate and a polyamine. As a general rule, the reaction product comprises a mixture of urea-containing species of varying chain length and urea content. However, by careful control of reaction variables such as, e.g., the relative quantities of reactants employed, the reaction temperature and the rate and order of reactant mixing, a product may normally be obtained which predominates in one polyurea species. The polyurea reaction is preferably carried out in situ in the grease carrier, and the reaction product may be utilized directly as a grease thickener.

While greases thickened with polyurea thickeners are in many respects superior to older lubricants in severe service application, especially with regard to maintainance of grease consistency at high temperatures, such greases suffer several disadvantages which limit their usefulness under practical service conditions. For example, in some instances, the product must be subjected to rotor/stator shear or high pressure Manton Gaulin milling to get the best penetration yield for the amount of gellant used. Again, while polyurea thickened greases show excellent retention of mechanical properties at high temperature (70° C. or above) and high or low shear, they tend to soften considerably when subjected to low shear at ambient temperature ranges (20°−30° C.). In fact, the tendency to soften at ambient temperature under low shear can be so great that the grease can, when subject to mechanical working under these conditions, undergo a change in penetration grade, e.g., from a No. 2 NLGI penetration grade to a No. 1 NLGI penetration grade. This change in penetration grade at ambient temperature under low shear is particularly troublesome since it may occur under practical use conditions when the grease is transferred from the original shipping container or is otherwise stirred or handled. Consequently, normal handling of the grease in making it available to the ultimate consumer may change it consistency to such extent that it is no longer the desired penetration grade for the intended application. While it is true that the change in consistency is reversible, in that the softened grease can be subjected to high shear at high temperatures (conditions used in the original grease preparation) to return the grease to its original consistency, this reversal often requires that the softened grease be shipped back to the formulator for reprocessing.

Accordingly, a need has existed for the development of a polyurea grease formulation which possesses improved mechanical properties. The invention satisfies that need, and provides improved composite polyurea grease compositions having enhanced mechanical stability.

SUMMARY OF THE INVENTION

More particularly the invention relates to novel composite polyurea compositions, and to novel grease compositions containing such polyureas. The compositions are formed by bringing their precursors together under controlled conditions so that the desired reactions take place in the manner contemplated. Accordingly, the invention relates to grease compositions comprising a lubricating oil base vehicle and a minor amount of the product obtained by reacting a monoamine (A) having the formula $NH_2R_1$, wherein $R_1$ is hydrocarbyl containing 3 to 30 carbon atoms, a monoamine (B) having the formula

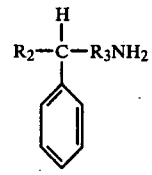

wherein $R_2$ is hydrocarbyl containing 6 through 12 carbon atoms, and $R_3$ is hydrocarbyl containing 8 through 12 carbon atoms, the amount of (B) being employed, with respect to (A), being from about 5 percent to about 50 percent, by weight, based on the total weight of (A) and (B), with a compound (C) having the formula $NH_2—C_2H_4—NH_2$ and a compound (D) having the formula OCN-$R_4$-NCO, wherein $R_4$ is hydrocarbylene having from 2 to 30 carbon atoms, the ratio of the total moles of monoamine and the moles of (C) and (D), i.e., (A+B):(C):(D), being from about 1.1 to 17:1:2 to 10. In its preferred form, the invention relates to grease compositions wherein the amount of (B) which is employed, with respect to (A), is from about 10 percent to 50 percent, by weight, based on the total weight of (A) and (B). Preferably, the ratio of the moles of monoamine and the moles of (C) and (D), i.e., (A+B):(C):(D) will be from about 5.5 to 6.5:1:3.5 to 4.5. In its most preferred form, the ratio of (A+B):(C):(D) is about 6:1:4. The reaction mixtures produced by the above-described reaction comprises theoretically, in most instances, a mixture of diurea and tetraurea with minor proportions of higher polymeric materials being present. However, since it is difficult to determine the exact proportions of the compounds present, and since the theoretical amounts are not necessarily present due to variation in reactivity of the various amines and the isocyanates, the materials are more appropriately described as products of the reactions. However, the compositions are in fact mixtures of these components, and they operate to give better mechanical properties to the final grease compositions than either diureas or tetraureas alone or than that which would be expected from their mixtures. The salient feature of the invention resides in the employment of (B) as a partial "substitution" for (A) in the polyurea combination. A much preferred "substitution" is the use of benzyloctadecyl amine for a portion of the monoamine.

As referred to herein, the term hydrocarbyl refers to a monovalent organic radical composed of hydrogen and carbon, and may be aliphatic, aromatic or alicyclic or combinations thereof, e.g., aralkyl, alkyl, aryl, cycloalkyl, alkylcycloalkyl, etc., and may be saturated or olefinically unsaturated (one or more double bonded carbons, conjugated or nonconjugated). The term hydrocarbylene refers to a divalent hydrocarbon radical which may be aliphatic, alicyclic, aromatic or combinations thereof, e.g., alkylarylene, aralkylene, alkylcycloalkylene, cycloalkylarylene, etc., having its two free valences on different carbon atoms.

The reaction is preferably conducted by rapidly contacting the reactants in a suitable vessel at a temperature between 140° F. and 200° F., preferably between 160° F. and 180° F. The reaction is exothermic. To achieve the full benefit of the invention, the monoamine reactants are preferably blended initially, in the ratios specified, and then combined with the polyamine and diisocyanate. The reaction proceeds virtually instantaneously, reaction times ranging from 0.0028 hours to 5 hours being suitable, or until the reaction has ceased, as observed. The molar ratios of the reactants employed are as noted, supra. Those skilled in art will recognize, of course, that commercially available reaction materials are rarely substantially pure, the reactants often containing varying proportions of isomers, related compounds, etc. For example, one commercially available toluene diisocyanate, used in the examples herein, is a mixture of isomers, and contains up to 20 percent by weight of 2,6-toluene diisocyanate, the remainder being substantially 2,4-toluene diisocyanate. Nonetheless, all weights and calculations based thereon, herein given, are stated as if pure materials were employed.

When employed in grease compositions, the compounds are present in a minor amount, the precise amount employed being dependent on the base vehicle, the properties desired, etc., such determinations being well within the ability of those skilled in the art. In general, amounts of from 4 to 12 percent by weight will be employed, with amounts of from 6 to 10 percent by weight being preferred. Obviously, where grease compositions are desired, the composition will be employed in an amount sufficient to thicken the vehicle to the consistency of a grease.

DETAILED DESCRIPTION OF THE INVENTION

The followng examples are illustrative of the invention.

EXAMPLE I

Theoretically stoichiometric amounts of reactants were used to give a mixture, by weight, of 58.8% tetraurea and 41% diurea in a slight excess of toluene diisocyanate. Specifically, 1.8 grams ethylene diamine (commercial grade, Union Carbide), 21.0 grams tallowamine (Armeen T, Armak Co.), and 10.35 grams of benzyloleylamine (10-phenyloctadecylamine) (Armeen LPS, Armak Co.) were heated to 160 degrees F. in 177.85 g of 500 SUS @ 100 degrees F. HVI oil and this was added to a Waring blender containing 17.4 g of toluene diisocyanate (commercial grade, Union Carbide) in 192.60 g of 500 SUS @ 100 degrees F. HVI oil at 160 degrees F. A grease immediately formed which had an ASTM penetration of 167 unworked and 167 worked. See No. 214A in Table I, below.

The same procedure was repeated in which the substitution of benzyloleylamine for tallowamine was varied from zero to 100%. The results of penetration tests on the greases formulated are shown in Table I. The data in Table I shows that about 30 percent by weight substitution approaches the best penetration yield, and also gives the least breakdown between unworked and worked penetrations.

TABLE I

| Batch Number | Percent Gellant | Percent Substitution | ASTM UNW/Worked C 77° F. | Open |
|---|---|---|---|---|
| 206A | 12 | 0 | 208/225 | 17 |
| 205A | 12 | 5 | 179/194 | 15 |
| 204A | 12 | 11.3 | 180/200 | 20 |
| 201A | 12 | 22.3 | 189/197 | 12 |
| 214A | 12 | 33 | 167/167 | 0 |
| 203A | 12 | 33 | —/152 | — |
| 207A | 12 | 43 | 196/196 | 0 |
| 208A | 12 | 53 | 200/210 | 10 |
| 202A | 12 | 100 | 309/329 | 20 |

EXAMPLE II

Using the approximately 30% optimum substitution figure found in Example I, theoretically stoichiometric amounts of reactants from the same sources were used to give a weight percent mixture of 32.4% tetraurea (Tu) and 67.6% diurea (Du). In this example, 1.474 grams of ethylene diamine, 29.4 g of tallowamine, and 14.5 grams of 10-phenyl octadecylamine were heated to 160 F. degrees in 592 g of 500 SUS @ 100 degrees F. HVI oil. This was added to 17.2 g of toluene diisocyanate in 592.4 g of 500 SUS 100 degrees F. HVI oil in a large Waring blender. A grease immediately formed which was later found to have a penetration 256 ASTM unworked and 266 @ 77 degrees F. worked.

This procedure was repeated in which the ratio of tetraurea to diurea was varied from 0% tetraurea to 100% tetraurea for 5, 6, 8, and 10.6% gellant (all by weight) in the greases. The penetration data obtained are shown in Table II.

In the greases containing higher percent gellants, batches were also included in which full tallowamine concentrations, that is no substitution of benzyloleylamine, was included. These were 2298A, 2300B, 2294A, 2298C, 2308 and 2307.

The results demonstrate that the use of benzyloleylamine as partial substitution for the tallowamine terminator in the polyurea gellant structure gives a harder grease, or allows the use of less gellant for the same penetration. The elimination of benzyloleylamine at low gellant concentrations results in considerable loss in yield. The penetration is less affected in gellant concentrations above 8.0%. In the 20 to 50 percent Tu range a practical #2 NLGI grade grease is possible with only 5% gellant.

TABLE II

| | | | | | | | No Gaulin Homogenization | |
|---|---|---|---|---|---|---|---|---|
| No | 2300B | 2300A | 2299A | 2298A | 2296 | 2292A | 2294A | 2314 |
| % Gellant | 10.61 | 10.61 | 10.61 | 10.61 | 10.61 | 10.61 | 10.61 | 10.61 |
| % TU | 0 | 0 | 100 | 100 | 19.7 | 37.7 | 37.7 | 100 |
| % DU | 100 | 100 | 0 | 0 | 80.3 | 62.3 | 62.3 | 0 |
| % Sub of tallowamine | 0 | 30 | 30 | 0 | 30 | 30 | 0 | 30 |
| Unw/60 | 306/380 | 318/356 | 220/238 | 228/246 | 191/211 | 197/205 | 177/201 | 201/230 |
| Drop Point | 298° | — | — | 489° | — | 490° | — | — |

TABLE II-continued

| No | 2301B | 2301BR | 2290C | 2292F | 2298C | 2299B | 2308 | 2292F | 2301BR2 |
|---|---|---|---|---|---|---|---|---|---|
| % Gellant | 8 | 8 | 8 | 8 | 8 | 8 | 8 | 8 | 8 |
| % TU | 15.2 | 15.2 | 60.3 | 37.3 | 100 | 100 | 19.5 | 37.3 | 19.8 |
| % DU | 84.8 | 84.8 | 39.7 | 62.7 | 0 | 0 | 80.5 | 62.7 | 80.2 |
| % Sub of tallowamine | 30 | 30 | 30 | 30 | 0 | 30 | 0 | 30 | 30 |
| Unw/60 | 245/277 | 248/280 | 237/241 | 220/218 | 326/337 | 313/303 | 289/363 | 247/255 | 207/251 |
| No | 2301AR | 2292G | 2290D | 2302A | 2292G | 2307 | | | |
| % Gellant | 6 | 6 | 6 | 6 | 6 | 5.7 | | | |
| % TU | 15.2 | 37.3 | 60.4 | 89.0 | 38.1 | 19.35 | | | |
| % DU | 84.8 | 62.7 | 39.6 | 11.0 | 61.9 | 80.65 | | | |
| % Sub of tallowamine | 30 | 30 | 30 | 30 | 30 | 0 | | | |
| Unw/60 | 295/305 | 227/258 | 268/285 | 316/315 | 227/258 | Fluid | | | |
| Drop Point °F. | — | — | 487 | — | — | — | | | |
| No | 2301C | 2303A | 2303AR | 2302B | 2306A | 2305ARR | 2305AR3 | 2306AA1 | 2303AR6 |
| % Gellant | 5 | 5 | 5 | 5 | 5 | 5 | 5 | 5 | 5 |
| % TU | 15.2 | 32.4 | 37.5 | 89.0 | 28.5 | 47.56 | 56 | 28.5 | 37.5 |
| % DU | 84.2 | 67.6 | 62.5 | 11.0 | — | 52.44 | 44 | 71.5 | 62.5 |
| % Sub of tallowamine | 30 | 30 | 30 | 30 | 30 | 30 | 30 | 30 | 30 |
| Unw/60 | 285/316 | 272/281 | 266/284 | 314/329 | 289/305 | 291/301 | 266/299 | 263/279 | 257/266 |
| Drop Point °F. | 476° F. | — | — | 430° F. | — | — | — | — | — |

EXAMPLE III

The purpose of this example is to show that partial substitution of benzyloleylamine for tallowamine in the structure of polyurea greases imparts mechanical stability to these greases. A polyurea grease was made up using the same procedure and reactants from the same sources as outlined in Examples I and II. The formula with 10.6% by weight gellant in this grease was calculated to give 100% tetraurea. There was 30% by weight substitution of benzyloleylamine for tallowamine. No Gaulin homogenization was used. The unworked and worked ASTM penetrations were 220/238 (No 2299A). The experiment was repeated using no benzyloleylamine substitution. The ASTM penetrations for this grease were 228/246 (No 2298A). Both greases were stirred in a Hobart mixer for 15 minutes as speed No. 2. The resulting ASTM unworked penetrations for 2299A was 309/276, and for batch number 2298A the penetrations were 333/318. This demonstrates that partial substitution of 10-phenyloctadecylamine for tallowamine in the tetraurea gellant gives added mechanical stability to the grease, or that less gellant may be used to get the same penetration. The results are shown in Table III.

TABLE III

| No | 2299A | 2298A |
|---|---|---|
| % Gel | 10.6 | 10.6 |
| Composition | 100% Tu | 100% Tu |
| % tallowamine sub. (by wt.) | 30.0% | 0% |
| Process Temp °F. | 210° F. | 210° F. |
| UNW/60 | 220/238 | 228/246 |
| Stir 15 min Hobart mixer No. 2 speed unw/60 | 309/276 | 333/318 |

EXAMPLE IV

The purpose of this example is to show that partial substitution of benzyloleylamine for tallowamine in the structure of polyurea greases imparts mechanical stability to these greases. A polyurea grease was made up using the same procedure and reactants from the same sources as outlined in Examples I and II. The formula with 10.6% gellant in this grease was calculated to give 100% durea. There was 30% substitution of benzyloleylamine for tallowamine. No Gaulin homogenization was used. The unworked and worked ASTM penetrations were 318/356 (No 2300A). The experiment was repeated using no benzyloleylamine substitution. The ASTM unworked and worked penetrations were 306/380 (2300B). This demonstrates that partial substitution of 10-phenyloctadecylamine for the tallowamine in the diurea structure gives increased yield to the grease, or that less gellant may be used to get the same penetration. The breakdown of 38 points for 2300A and 74 points for 2300B also indicates an improvement in mechanical stability. The results are shown in Table IV.

TABLE IV

| No | 2300B | 2300A |
|---|---|---|
| Type | Straight Du No benzyloleylamine | Straight Du w/ benzyloleylamine |
| unw/60 | 306/380 | 318/356 |
| Final Temp | 180° F. | 180° F. |
| Tu/Du | 0/100 | 0/100 |
| % Gel (by wt.) | 10.6 | 10.6 |
| % benzyloleylamine (by wt.) | 0.0 | 30% |

EXAMPLE V

The effect of benzyloleylamine on tetraurea/diurea mixtures is much greater than that on the straight TU and DU greases. The improvement in yield is very significant especially in low gel greases. As shown in Table V, grease No. 2306 has only 5% gellant and is a No. 2 NLGI grade. The TU/DU grease without the benzyloleylamine substitution was fluid at 5.7% gellant.

TABLE V

| % Gel TU/DU | Unsubstituted | Substituted |
|---|---|---|
| 12% (37.7 TU/62.3 DU) | 2292A (199/205) | 2294A (177/201) |
| 8% (100% TU) | 2298C (—/337) | 2299B (—/303) |
| 8% (195 TU/62.3 DU) | 2308 (—/363) | 2301 BR2 (—/251) |
| 5.7% (19.35/80.65) | 2307 (Fluid) | 2306 ARI (263/279) (5% 28.5 TU/27.5 DU) |

What is claimed is:

1. A grease composition comprising a lubricating oil base vehicle and a minor amount of the product obtained by reacting a monoamine (A) having the formula $NH_2R_1$, wherein $R_1$ is hydrocarbyl containing 3 to 30 carbon atoms, a monoamine (B) having the formula

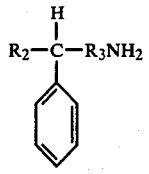

wherein $R_2$ is hydrocarbyl containing 6 through 12 carbon atoms, and $R_3$ is hydrocarbyl containing 8 through 12 carbon atoms, the amount of (B) being employed, with respect to (A), being from about 5 percent to about 50 percent, by weight, based on the total weight of (A) and (B), with a compound (C) having the formula $NH_2—C_2H_4NH_2$ and a compound (D) having the formula $OCN—R_4—NCO$, wherein $R_4$ is hydrocarbylene having from 2 to 30 carbon atoms, the ratio of the total moles of monoamine and the moles of (C) and (D), (A+B):(C):(D), being from about 1.1 to 17:1:2 to 10.

2. The composition of claim 1 wherein the amount of (B), with respect to (A), is from 10 percent to 50 percent, by weight, based on the total weight of (A) and (B).

3. The composition of claim 2 wherein the ratio of the total moles of monoamine (A+B) and the moles of (C) and (D), (A+B):(C):(D), is from about 5.5 to 6.5:1:3.5 to 4.5.

4. The composition of claim 3 wherein the monoamine(B) is 10-phenyloctadecyl amine.

* * * * *